US008453629B2

(12) United States Patent
Nakano et al.

(10) Patent No.: US 8,453,629 B2
(45) Date of Patent: Jun. 4, 2013

(54) SPARK-IGNITION ENGINE

(75) Inventors: Keiichi Nakano, Sakai (JP); Toshihiko Teramoto, Sakai (JP); Wataru Okada, Sakai (JP); Emi Tabata, Sakai (JP)

(73) Assignee: Kubota Corporation, Osaka ( * ) Notice: Subject to any disclaimer, the term of this patent is extended or adjusted under 35 U.S.C. 154(b) by 588 days.

(21) Appl. No.: 12/721,673

(22) Filed: Mar. 11, 2010

(65) Prior Publication Data

US 2010/0242932 A1 Sep. 30, 2010

(30) Foreign Application Priority Data

Mar. 31, 2009 (JP) ..... 2009-087830
Feb. 24, 2010 (JP) ..... 2010-038925

(51) Int. Cl.
*F02P 3/02* (2006.01)

(52) U.S. Cl.
USPC ..... 123/635; 123/143 C; 123/193.5

(58) Field of Classification Search
USPC ..... 123/143 C, 143 R, 146.5 R, 169 R, 123/193.2, 193.3, 193.5, 195 C, 634, 635
See application file for complete search history.

(56) References Cited

U.S. PATENT DOCUMENTS 6,513,506 B1 * 2/2003 Ito et al. ..... 123/568.13
6,668,784 B1 * 12/2003 Sellers et al. ..... 123/193.5
6,668,810 B1 * 12/2003 St. John et al. ..... 123/634
6,701,883 B2 * 3/2004 Matsumoto ..... 123/193.5
2003/0070665 A1 * 4/2003 Paul et al. ..... 123/635
2005/0172940 A1 * 8/2005 Iizuka et al. ..... 123/635
2009/0007878 A1 * 1/2009 Korenjak et al. ..... 123/193.5
2009/0126674 A1 * 5/2009 Takasu et al. ..... 123/193.5
2009/0229574 A1 * 9/2009 Takasu et al. ..... 123/470
2011/0017159 A1 * 1/2011 Schneiker ..... 123/90.23
2011/0155084 A1 * 6/2011 Sargeant ..... 123/90.15

FOREIGN PATENT DOCUMENTS

JP 05099112 A 4/1993
JP 2002-213334 A 7/2002

* cited by examiner

*Primary Examiner* — John T. Kwon
*Assistant Examiner* — Johnny Hoang
(74) *Attorney, Agent, or Firm* — Panitch Schwarze Belisario & Nadel LLP

(57) ABSTRACT

A spark-ignition engine comprises a plug hole (13) formed in a cylinder head (2), an ignition plug (10) and a plug cap (9) of the type integral with an ignition coil, which is attached to the ignition plug (10) as it is inserted into the plug hole (13). In this spark-ignition engine, the plug hole (13) is arranged at a position outside a head cover (5) in the cylinder head (2), a head surface (2*a*) of which is opened to provide the plug hole (13) and has a plug-cap attaching flange (11) attached thereto, and the plug-cap attaching flange (11) is formed with an extending cylinder-portion (15A) having an extension-hole (15) communicated with the plug hole (13). The plug cap (9), as it is inserted from the extension hole (15A) into the plug hole (13), has a coil portion (9C) fixed to the extending cylinder-portion (15).

12 Claims, 12 Drawing Sheets

18
18A
18B
18a
26
27
28
29
29A
29B
30
31
31a
A
B
C
D
E
H

SPARK-IGNITION ENGINE

TECHNICAL FIELD

The present invention relates to a spark-ignition engine and more particularly, a spark-ignition engine which comprises a plug hole provided with a plug-attaching aperture at its innermost portion and formed in a cylinder head, an ignition plug engaged in screw-thread relationship with the plug-attaching aperture, and a plug cap of the type integrally formed with an ignition coil, that is attached to the ignition plug as it is inserted into the plug hole (direct-ignition plug cap).

BACKGROUND ART

The engine of this type, i.e., a spark-ignition engine which adopts the plug cap of the type integral with the ignition coil (and allocates a corresponding ignition coil per ignition plug of every cylinder and take the electronically electric-distributing system for controlling the electric-distribution in correspondence with the cylinder's timing) has a long lifetime period and can alleviate the electric-wave noise originated from the electrical-energy distributor of high voltage. Further, it has a certain degree of freedom at the ignition timing and is more advantageous on the point of the optimum ignition-timing control than the distributor system and therefore is coming to lead the others.

For example, the plug cap of the type integral with the ignition coil the Patent Literature 1 discloses, as shown in FIG. 2, has such a structure that a plug is inserted into a deep plug hole intended for the ignition plug to be arranged between a pair of intake and exhaust valves opposite to each other. The ignition coil is placed on a recess for attachment, formed by concaving an upper surface of a cylinder head-cover downwardly and fixed thereto.

A shielding cylindrical member that forms the plug hole is fitted into an attaching hole of the cylinder head and has an upper end extending through the cylinder head-cover. In consequence, the plug cap can be attached in such a manner that it drops from above the head cover into the shielding cylindrical member.

PRIOR ART LITERATURE

Patent Literature

[Patent Literature 1] Patent Application Laid-Open No. HEI 5-099112

OUTLINE OF THE INVENTION

Problem the Invention Attempts to Solve

The shielding cylindrical member is press-inserted into the plug hole of the cylinder head inside the cylinder head-cover. This has caused a problem that the engine oil is likely to invade the plug hole.

The present invention has an object to provide a spark-ignition engine unlikely allowing the engine oil to invade and able to perform a stable spark-ignition, so as to adopt the structure that utilizes the plug cap of the type integral with the ignition coil.

Means for Solving the Problem

The invention as set forth in claim 1 is a spark-ignition engine, as shown in FIG. 3, which comprises a plug hole 13 provided with a plug-attaching aperture 12 at its innermost portion and formed in a cylinder head 2, an ignition plug engaged in screw-thread relationship with the plug-attaching aperture 12, and a plug cap 9 of the type integral with the ignition coil, which is attached to the ignition plug 10 as it is inserted into the plug hole 13.

In this engine, as exemplified in FIG. 3, the plug hole 13 is arranged at a position outside a head cover 5 at the cylinder head 2, a head surface 2*a* of which is opened to provide the plug hole 13 and has a plug-cap attaching flange 11 attached thereto, and the flange 11 is formed with an extending cylinder-portion 15 having an extension hole 15A communicated with the plug hole 13. The plug cap 9, as it is inserted from the extension hole 15A into the plug hole 13, has a coil portion 9C fixed to the extending cylinder-portion 15.

Effect of the Invention

According to the invention as defined in claim 1, as exemplified in FIG. 3, the plug hole 13 is arranged at a position outside the head cover 5 in the cylinder head 2. This arrangement can prevent the invasion of the engine oil into the plug hole 13.

Further, the plug-cap attaching flange 11 with the extending cylinder-portion 15 is formed separately from the cylinder head 2. Thus when compared with the case of forming the extending cylinder-portion 15 integrally with the cylinder head 2, it offers an advantage to facilitate the working and the handling of the cylinder head 2.

According to the invention as defined in claim 2, only one of the plug-cap attaching flanges 11 is integrally provided with the extending cylinder-portion 15 in plural number. Therefore, a plurality of plug caps 9 are preliminarily attached to the plug-cap attaching flange 11 all together on a sub-production line. Subsequently, the parts attached all together as such are assembled onto the cylinder head 2 on a main production line. Thus it additionally offers an advantage of enabling a well efficient production way to be executed by conducting such a pre-assembling as mentioned above.

According to the invention as defined in claim 3, as exemplified in FIGS. 1, 8, 9, 11 and 12, a delivery pipe 18 is provided as it passes by the plural extending cylinder-portions 15 and is attached to at least two of the extending cylinder-portions 15 respectively through fixing means 32. This mutually connects the plural extending cylinder-portions 15 though the delivery pipe 18 so as to inhibit the swinging of the extending cylinder-portions 15 and eventually that of the coil portion 9C of the plug cap 9 to be fixed to each of them, with the result of being able to suppress the function-reduction of the coil portion 9C.

According to the invention as defined in claim 4, as shown in FIGS. 5(*a*) and 5(*b*), the extending cylinder-portions 15 are integrally provided with a single attaching flange 11. This makes it possible to perform a pre-assembling work which comprises preliminarily attaching a plurality of plug caps 9 to the plug-cap attaching flange 11 on the sub-production line all together at once and subsequently assembling the parts attached all together as such onto the cylinder head 12 on the main production line, thereby enabling the well efficient production way to be executed.

According to the invention as defined in claim 5, as shown in FIG. 8, a plurality of injectors 25 are attached to the delivery pipe 18, and as shown in FIGS. 4, and 5(*a*) and 5(*b*), the injectors 25 are inserted into a plurality of injector insertion holes 11*a* provided in the single plug-cap attaching flange 11, respectively. In consequence, the delivery pipe 18 and the plural injectors 25 in addition to the plug caps 9 are attached to the single plug-cap attaching flange 11 all together and thereafter the parts attached all together as such are assembled to the cylinder head 2 on the main production line. Such a pre-assembling work can be conducted, thereby allowing the well efficient production way to be performed.

According to the invention as defined in claim 6, as exemplified in FIG. 3, the plug-cap attaching flange 11 is attached to the head surface 2*a* through a sealing means 17 and the plug cap 9 is constructed so as to form a cap for the extension hole 15A. This maintains the plug hole 13 and the extension hole 15A which house the plug cap 9 as hermetically sealed to thereby offer an advantage of preventing the invasion of not only the engine oil but also the foreign matters such as the rain water, the garbage, the dust or the like. In this case, as in the case of claim 7, a gasket, which is easily available, is preferably used for the sealing means 17.

According to the invention as defined in claim 8, as exemplified in FIGS. 1 to 4, the extending cylinder-portion 15 is arranged within an air-conduction passage for the engine cooling-air to be sent by an engine cooling fan 14 so that the heat, which is conducted to the coil portion 9C of the plug cap 9 through the extending cylinder portion 15, is radiated into the engine cooling-air to thereby inhibit the overheating of the coil portion 9C.

According to the invention as defined in claim 9, as shown in FIGS. 1 and 2 for example only, the air-conduction passage 42 has left and right air-conducting guide portions, which are constructed from an intake manifold 8 and the head cover 5, respectively. This makes it possible to form the air-conduction passage 42 by the existing intake manifold 8 and head cover 5 without adding any new part.

According to the invention as defined in claim 10, as exemplified in FIG. 1, the intake manifold 8 has a parent pipe 7 to a front end portion of which a throttle body 43 is attached. This throttle body 43 and the head cover 5 form the left and right air-conducting guide portions of an inlet portion 42A of the air-conduction passage 42. Therefore, without adding any new part, the throttle body 43 and the head cover 5 can constitute the inlet portion 42A of the air-conduction passage 42.

According to the invention as defined in claim 11, as shown in FIGS. 1 and 2, an air-conduction plate 45 is arranged on an upper side of the air-conduction passage 42 while covering it from above. An electronic-parts housing portion 46 is disposed on an upper surface of the air-conducting plate 45. Owing to this arrangement, the air-conducting plate 45 shields the upward escape of the engine cooling-air to thereby inhibit the engine cooling-air from flowing out of the air-conduction passage 42.

Besides, the electronic-parts housing portion 46 being disposed on the upper surface of the air-conducting plate 45, this air-conducting plate 45 can also serve as a portion for setting the electronic-parts housing portion 46.

According to the invention as defined in claim 12, as shown in FIGS. 1 and 2, a wire harness 48 is supported by the upper surface of the air-conducting plate 45. Thus the air-conducting plate 45 is also usable as a support portion for the wire harness 48.

According to the invention as defined in claim 13, as exemplified in FIGS. 1 and 2, the air-conducting plate 45 is attached to the intake manifold 8, thereby enabling the temperature of the air-conducting plate 45 to maintain at a relatively low temperature. This can inhibit the overheating of the electronic parts housed within the electronic-parts housing portion 46 and the wire harness 48.

According to the invention as defined in claim 14, a breather passage 47, which extends from the head cover 5 side to the intake manifold 8 side, is arranged at a portion which the engine cooling-air blows against. This radiates the heat of the blow-by gas introduced into the intake manifold 8 side into the engine cooling-air to thereby inhibit the reduction of the intake-air filling efficiency.

BRIEF DESCRIPTION OF THE DRAWINGS

FIG. 5(*a*) is a plan view and FIG. 5(*b*) is a side view.

FIG. 7(*b*) is a sectional view taken along a line B-B in FIG. 7(*a*); FIG. 7(*c*) is a sectional view taken along a line C-C in FIG. 7(*a*); FIG. 7(*d*) is a sectional view taken along a line D-D in FIG. 7(*a*); FIG. 7(*e*) is a view seen in a direction designated by an arrow E in FIG. 7(*a*); FIG. 7(*f*) is a plan view of an injector-stopper; FIG. 7(*g*) is a side view of the injector-stopper; FIG. 7(*h*) is a sectional view taken along a line H-H in FIG. 7(*g*).

MOST PREFERRED EMBODIMENT OF THE INVENTION

Hereafter, an embodiment of a spark-ignition engine according to the present invention is explained when it is applied to a vertical straight multi-cylinder (four-cylinder) diesel engine, with reference to the drawings.

Figure 1:
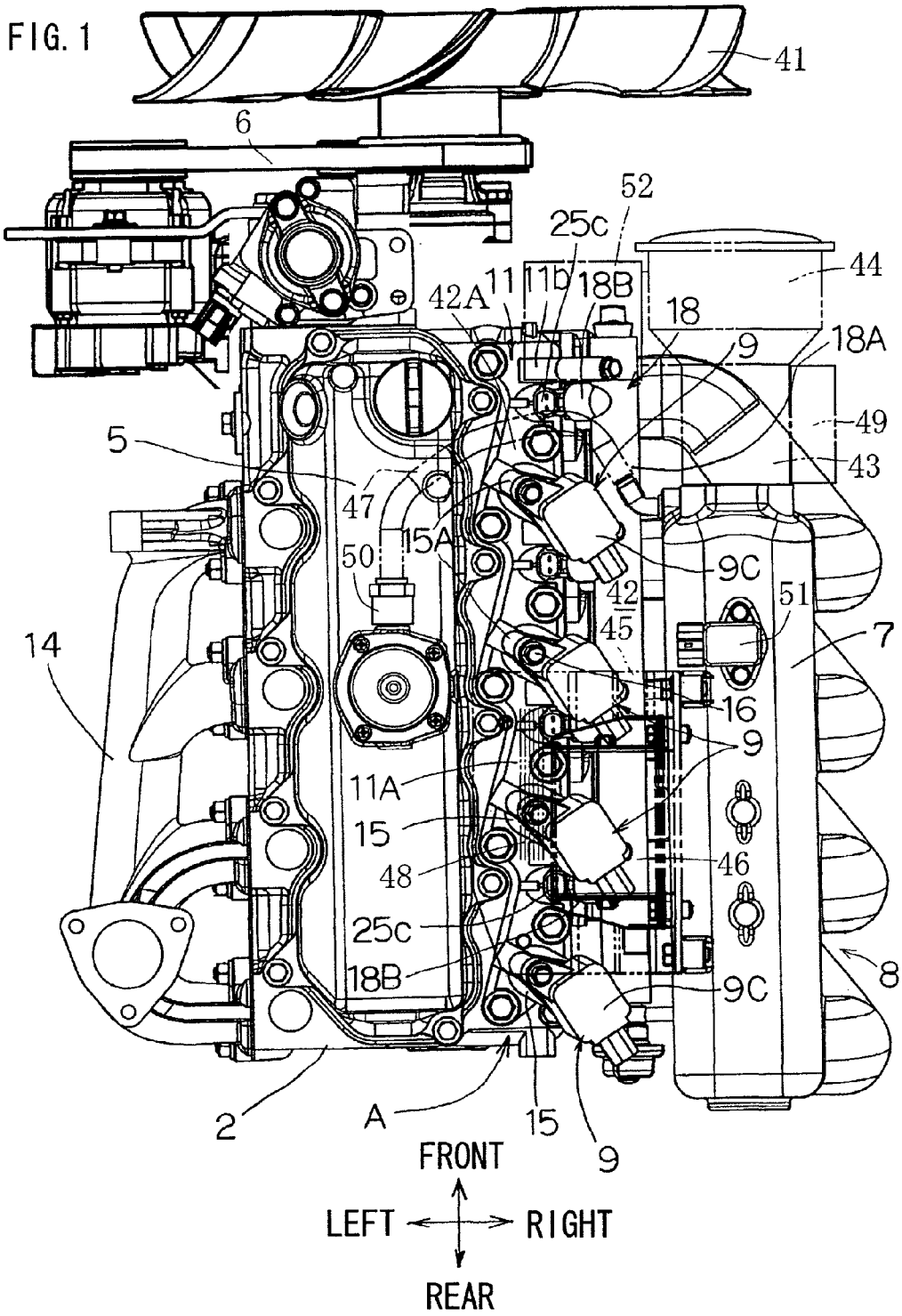
FIG. 1 is a plan view of a spark-ignition engine.
Figure 12:
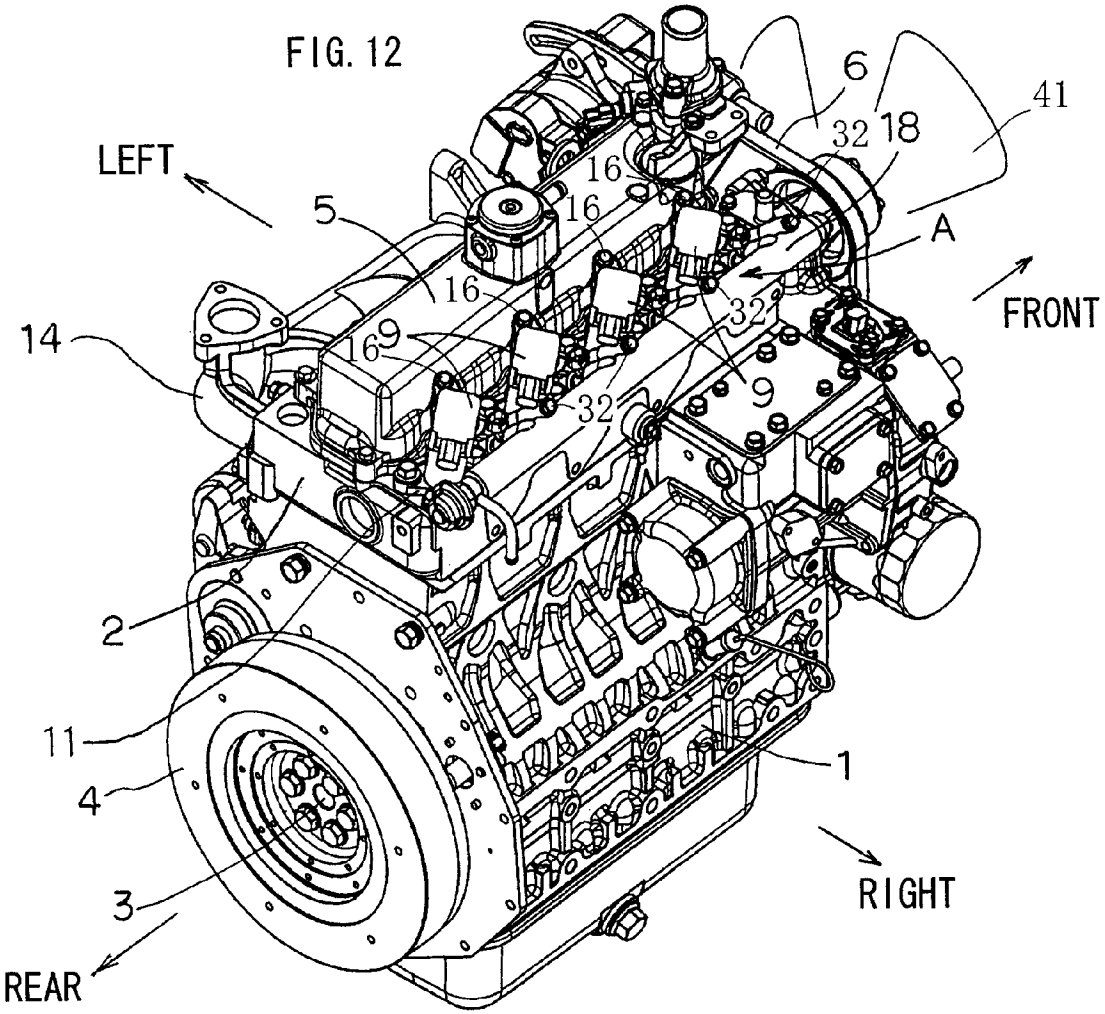
FIG. 12 is a perspective view of the whole spark-ignition engine.

FIGS. 1 and 12 each shows a vertical straight four-cylinder diesel engine which uses the liquid fuel and the gaseous fuel alternatively.

First, a width direction of a cylinder block 1 or a cylinder head 2 is deemed as a horizontal direction and a direction in which a crank shaft 3 spans is taken as a front and rear direction. In the front and rear direction, one side on which a fly wheel 4 exists is regarded as the rear and the opposite side is taken as the front. And in the horizontal direction, one side on which an exhaust manifold 14 exists is deemed as the left and the opposite side on which an intake manifold 8 is present is taken as the right. The cylinder block 1 has an upper portion to which a cylinder head 2 is assembled. This cylinder head 2 has an upper portion to which a head cover 5 is assembled. An engine cooling-fan 41 to be driven through a transmission belt 6 is arranged in front of the cylinder block 1 and a fly-wheel 4 is disposed at the rear of the cylinder block 1.

As shown in FIGS. 1, 2 and 8 to 12, the intake manifold 8 is arranged on the right side of the cylinder head 2 and the exhaust manifold 14 is disposed on the left side thereof. The head cover 5 is placed on a position offset toward the left side on a head surface 2*a*, which is a flat upper surface, of the cylinder head 2. The head surface 2*a* has a right side on which an ignition device (A) is arranged. The ignition device (A) comprises an ignition plug 10, which is attached in screw-thread engagement to the plug-attaching hole 12, a plug cap 9 of the type integral with an ignition coil, which is provided for every ignition plug 10, and a plug-cap attaching flange 11 for supporting four plug caps 9.

Figure 3:
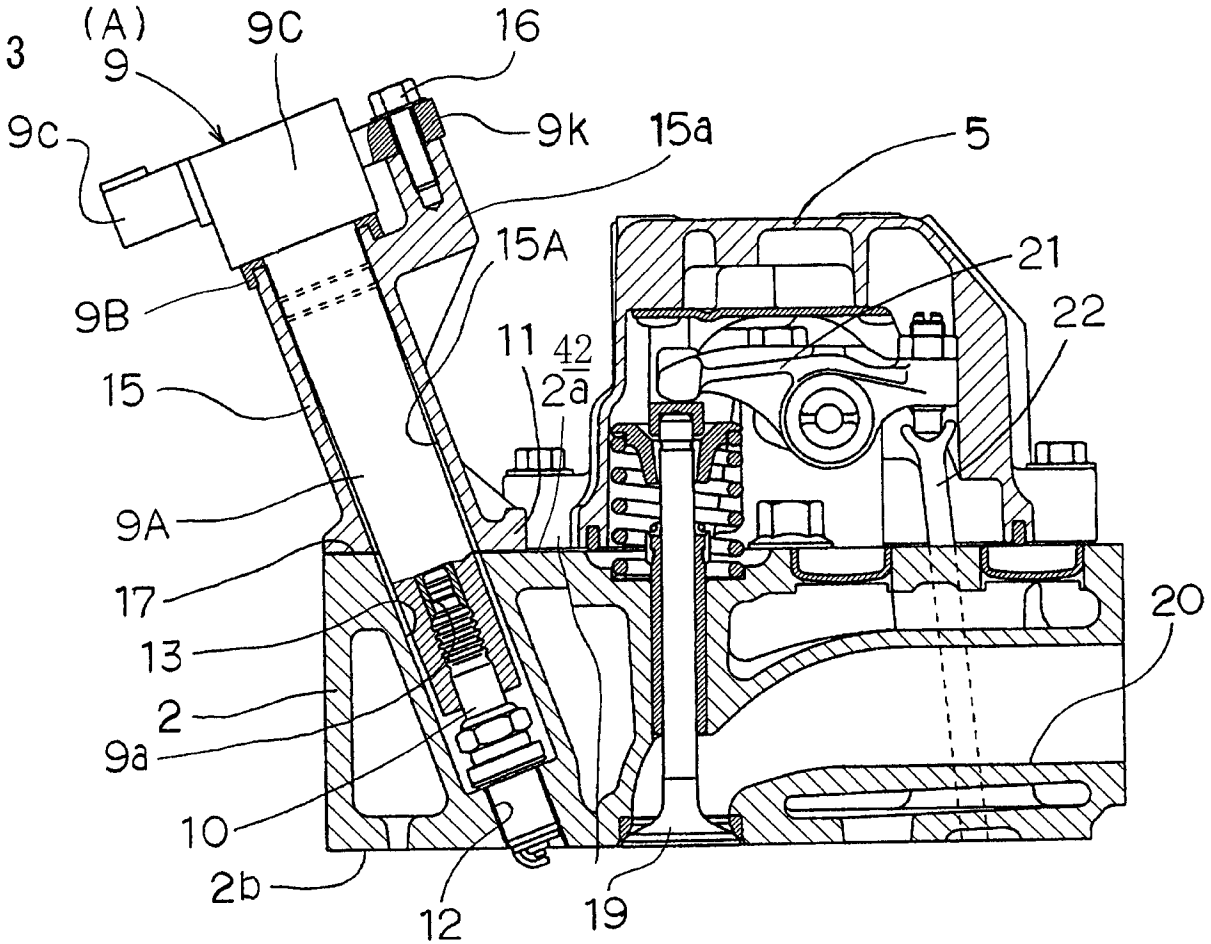
FIG. 3 is a sectional view of an essential portion showing a structure for attaching a plug cap.

As shown in FIG. 3, the device (A) includes a plug hole 13 provided with a plug-attaching aperture 12, a threaded one, at the innermost portion and formed in the cylinder head 2, an ignition plug 10 to be engaged in screw-thread relationship with the plug-attaching aperture 12, and a plug cap 9 consolidated with ignition-coil that is attached to the ignition plug 10 as it is inserted into the plug hole 13. The plug hole 13 is provided as an inclined hole coming closer to the intake manifold 7 side as it goes upper and upper at a position outside the head cover 5 in the cylinder head 2. The head upper surface (one example of the head surfaces) 2*a*, is opened to provide the plug hole 13 and has the plug-cap attaching flange 11 attached thereto through a gasket (one example of the sealing means) 17. An extending cylinder-portion 15 having an extension hole 15A communicated with the plug hole 13 is integrally formed with the plug-cap attaching flange 11. The plug cap 9 as inserted from the extension hole 15A into the plug hole 13 has a coil portion (ignition coil) 9C fastened to the extending cylinder-portion 15 of the plug-cap attaching flange 11 through a bolt 16 (one example of the fixing means). Further, numeral 2*b* designates a flat head under-surface that connects the cylinder head 2 to an upper surface of the cylinder block 1 (not shown).

The pug cap 9 of the type integral with the ignition coil is formed as an integral part which comprises a holder portion 9A externally fitted onto the ignition plug 10 and having at its lower end a charging bore 9*a* able to be passed therethrough and hold the ignition plug 10, a closure portion 9B and the coil portion 9C. An electric-conductor is housed within the holder portion 9A and executes an electric-conduction from the coil portion 9C to the ignition plug 10. The closure portion 9B has a function to cover and close an upper end of the extending cylinder-portion 15 without any clearance when it is inserted into the extending cylinder-portion 15 for attachment, so as to inhibit the invasion of the garbage and the like foreign matters into the extension hole 15A. The coil portion 9C includes a connector 9*c* and a flange 9*k*. The flange 9*k* is fastened by a bolt 16 to an upper surface (not designated by numeral) of an attaching arm-portion 15*a* which projects from the extending cylinder-portion 15 so as to fix the plug cap 9 to the extending cylinder-portion 15, namely the plug-cap attaching flange 11. Further, in FIG. 3, numerals 19, 20, 21 and 22 indicate an exhaust valve, an exhaust port formed in the cylinder head 2, an exhaust-side rocker arm and an exhaust-side push rod, respectively.

Figure 4:
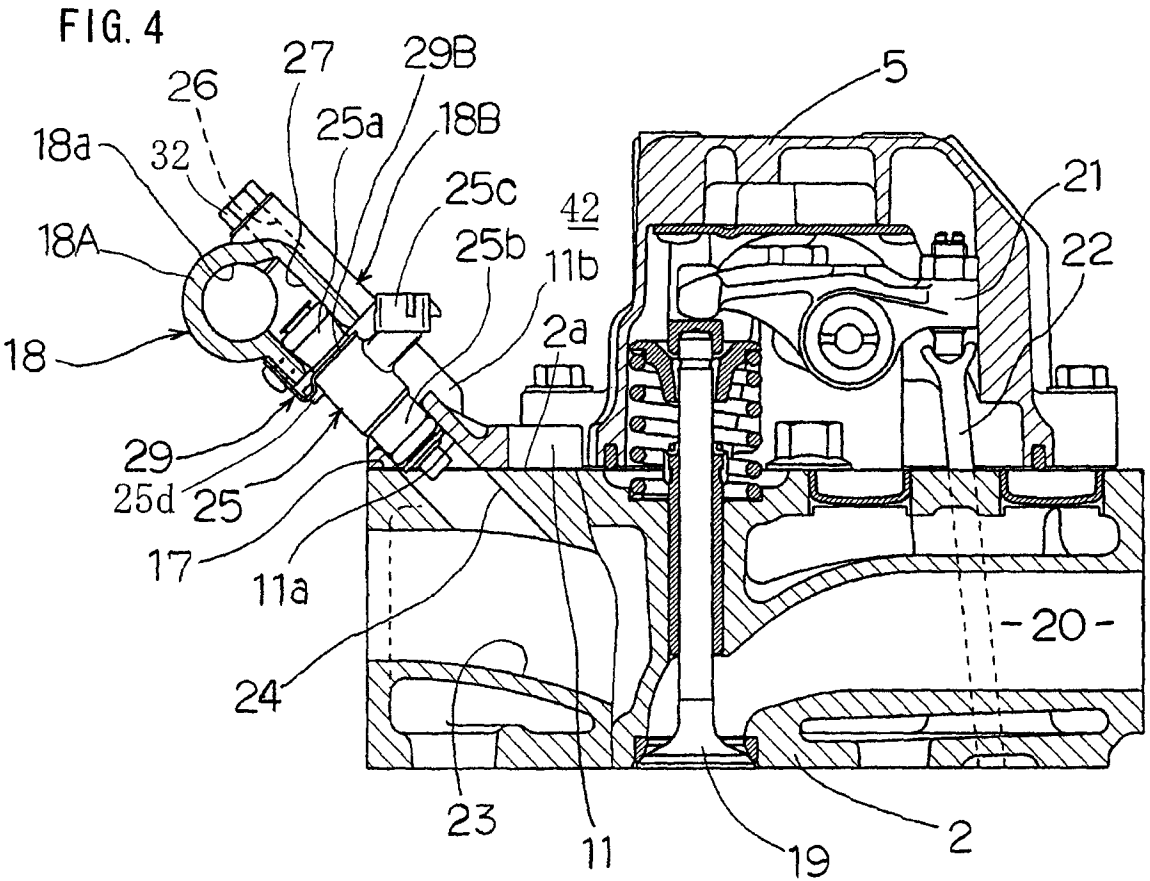
FIG. 4 is a sectional view of an essential portion showing a structure of a fuel supply system.
Figures 5A, 5B:
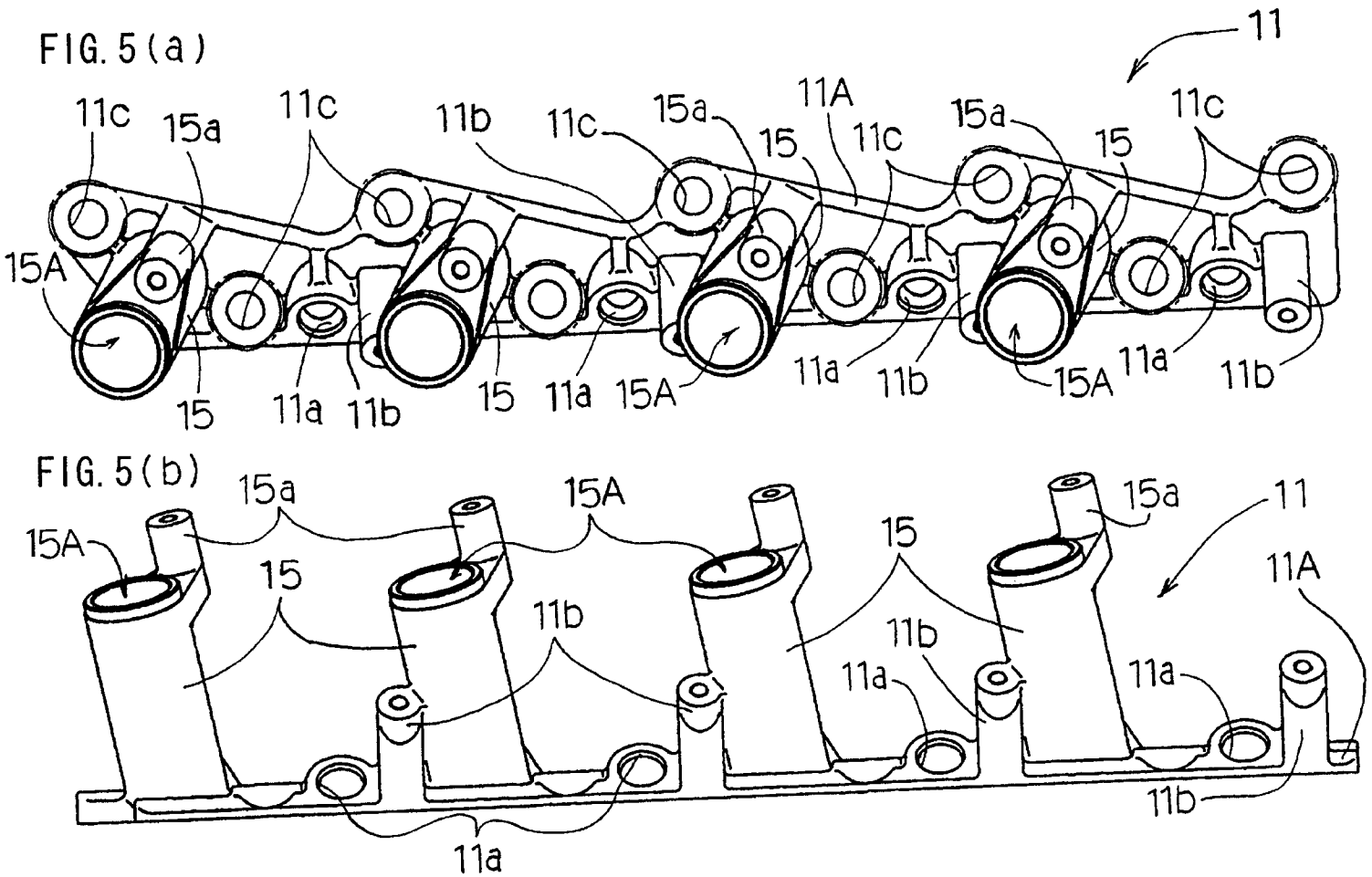
FIG. 5 shows a plug-cap attaching flange.
Figure 6A:
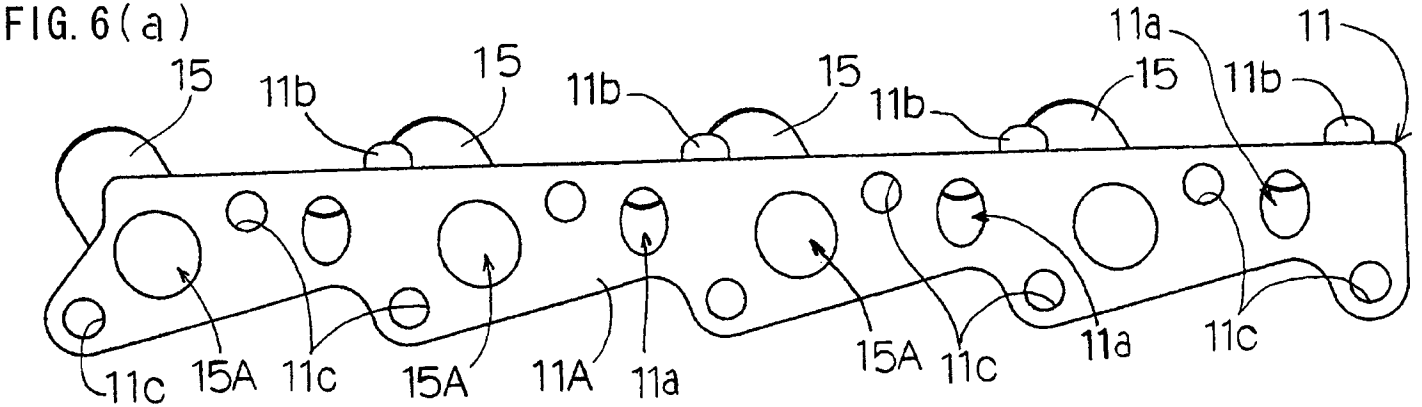
FIG. 6 FIG. 6(*a*) is a bottom view of the plug-cap attaching flange and FIG. 6(*b*) is a bottom view of a gasket.
Figure 6B:
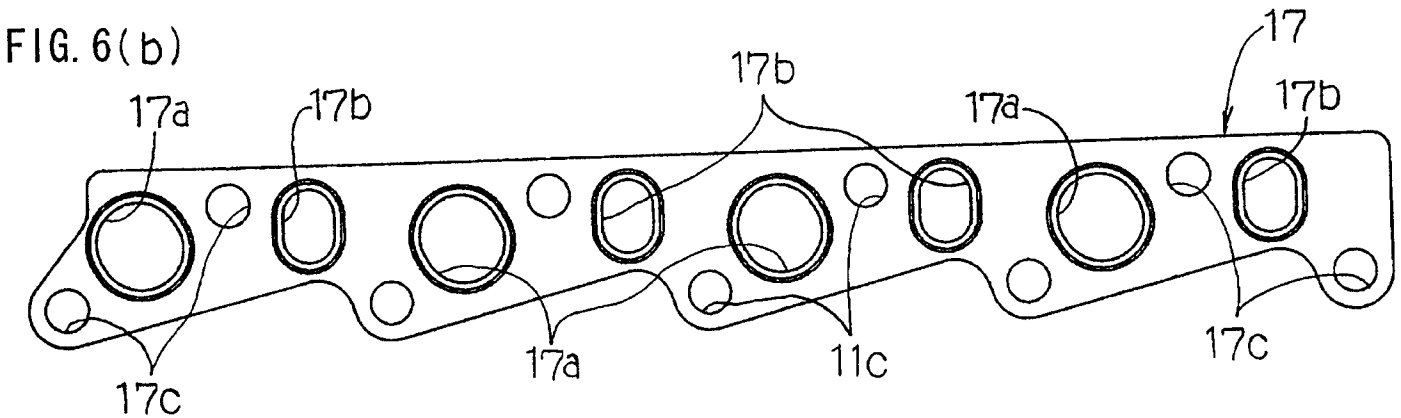

The plug-cap attaching flange 11, as shown in FIG. 3, FIGS. 4(*a*) and 4(*b*), FIG. 5 and FIG. 6(*a*), comprises a single flange portion 11A which is fastened by bolt through the gasket 7 to the upper surface 2*a* of the cylinder head 2 in surface-contact therewith, the extending cylinder-portions 15 raised from the flange portion 11A to be formed at four positions, injector-insertion holes 11*a* provided at four positions for attaching the injectors 25, nut portions 11*b* raised at four positions for fastening the delivery pipe 18 by bolt, and attaching holes 11*c* for fastening by bolt at nine positions all formed integrally with the others. More specifically, the cylinder head 2 is provided at four positions (an example of the plural provision) with the plug holes 13. The extending cylinder-portions 15 are provided at four positions in correspondence with the plug holes 13 at the four positions and are also integrally formed with the plug-cap attaching flange 11. Although not shown, the plug-cap attaching flanges 11 may be constructed such that four ones are formed independently for every cylinder and the four plug-cap attaching flanges 11, each of which is separate one, are attached separately to the cylinder head 2. Besides, the sealing means 17 may be a liquid gasket (bond sealing) or any means other than the liquid gasket.

The gasket 17 is, as shown in FIG. 6(*b*), formed such that it comprises apertures 17*a* each provided for the extension holes at four positions, another holes 17*c* each for inserting the injector at four positions, and still another hole 17*c* each for bolts at nine positions. Each of the extension-hole apertures 17*a* and the injection-insertion apertures 17*b* is so constructed that its peripheral edge portion has a sealing property to be reinforced by a steel plate material such as SPCC.

The cylinder head 2 is, as shown in FIG. 4 as well as in FIGS. 1, 2, 8 and 9, formed with an intake port 23 and a injection hole 24 inclined so as to be communicated with the intake port 23. The plug-cap attaching flange 11 has an injector-insertion hole 11*a*, which is a portion for hermetically inserting a lower portion 25*b*, i.e., a leading end portion of the injector 25 as it is inclined along the injection hole 24 and is opposite thereto. Four injectors 25 each has an upper portion 25*a* that comes to be a base end portion, inserted into and supported by a delivery pipe 18 arranged as it extends in the front and rear direction and is laid in a horizontal direction. The delivery pipe 18 is formed into a structure that is secured by a fixing means 32 to the raised nut portions 11*b* provided at, in total, four positions. Three of the four raised nut portions 11*b* are integrally formed with the extending cylinder-portions 15, respectively. Further, numeral 25*c* designates a connector of the injector 25.

Figures 7A, 7B, 7C, 7D, 7E, 7F, 7G, 7H:
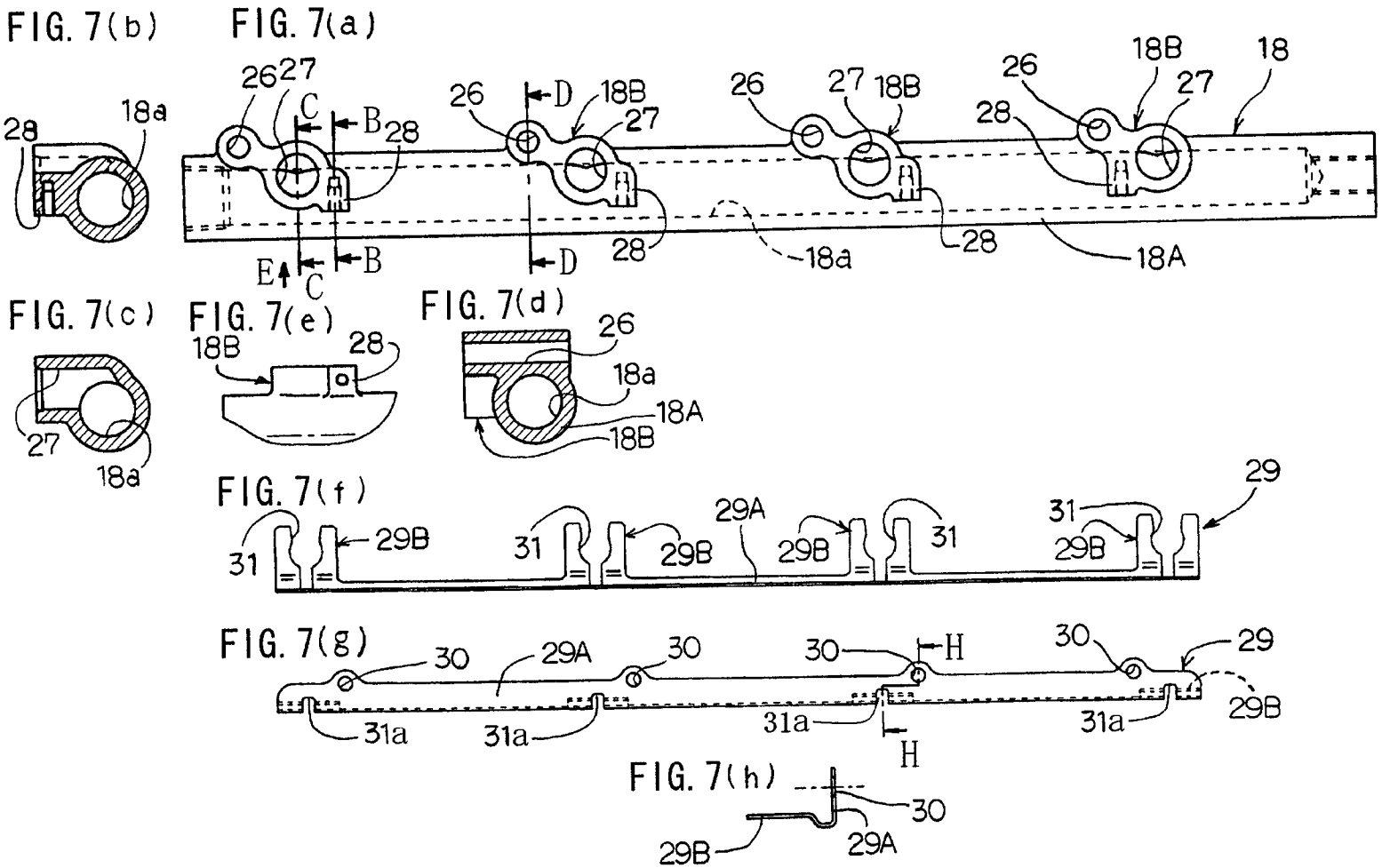
FIG. 7 FIG. 7(*a*) is a bottom view of a delivery pipe.
Figure 8:
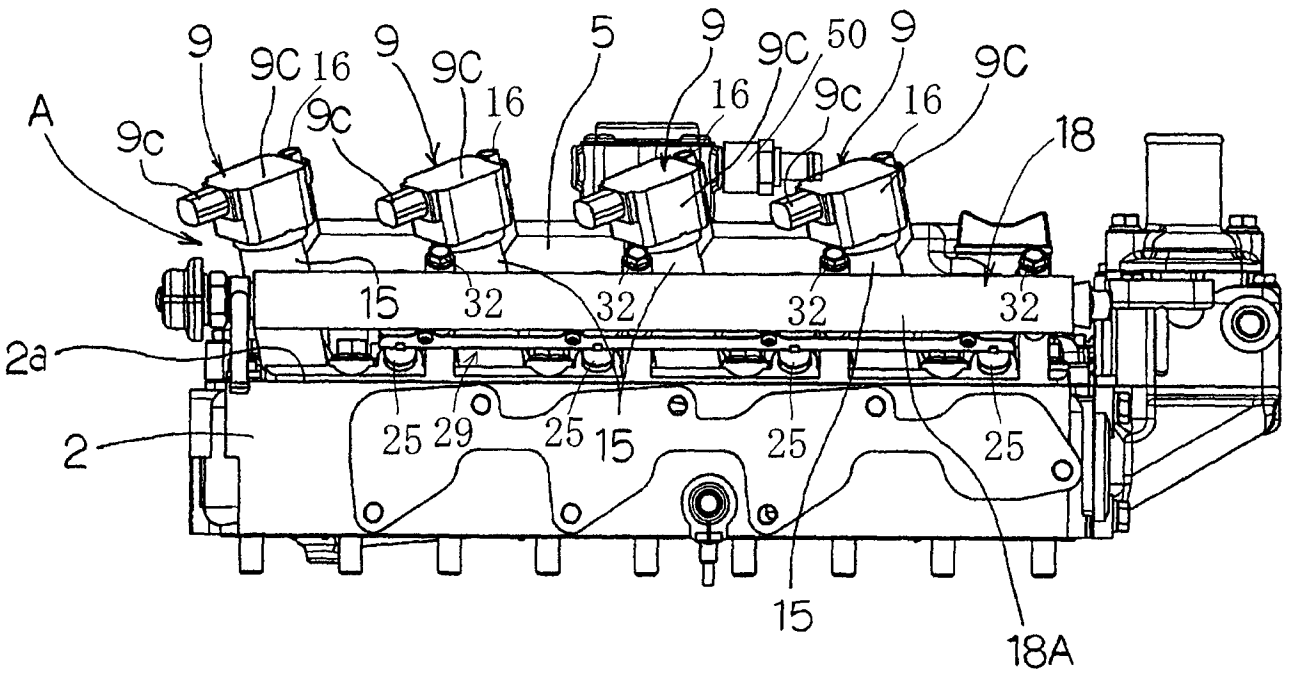
FIG. 8 is a side view showing an intake side of the head cover and its peripheral portion.
Figure 9:
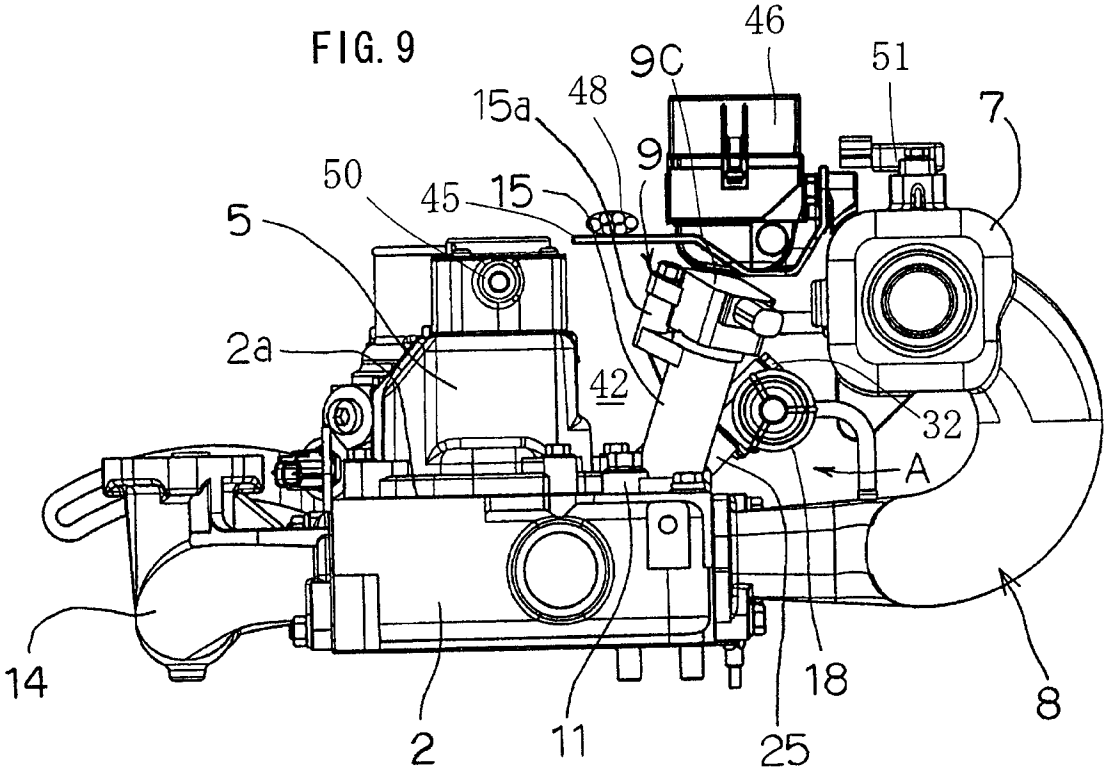
FIG. 9 is a rear view showing the head cover and its peripheral portion.
Figure 10:
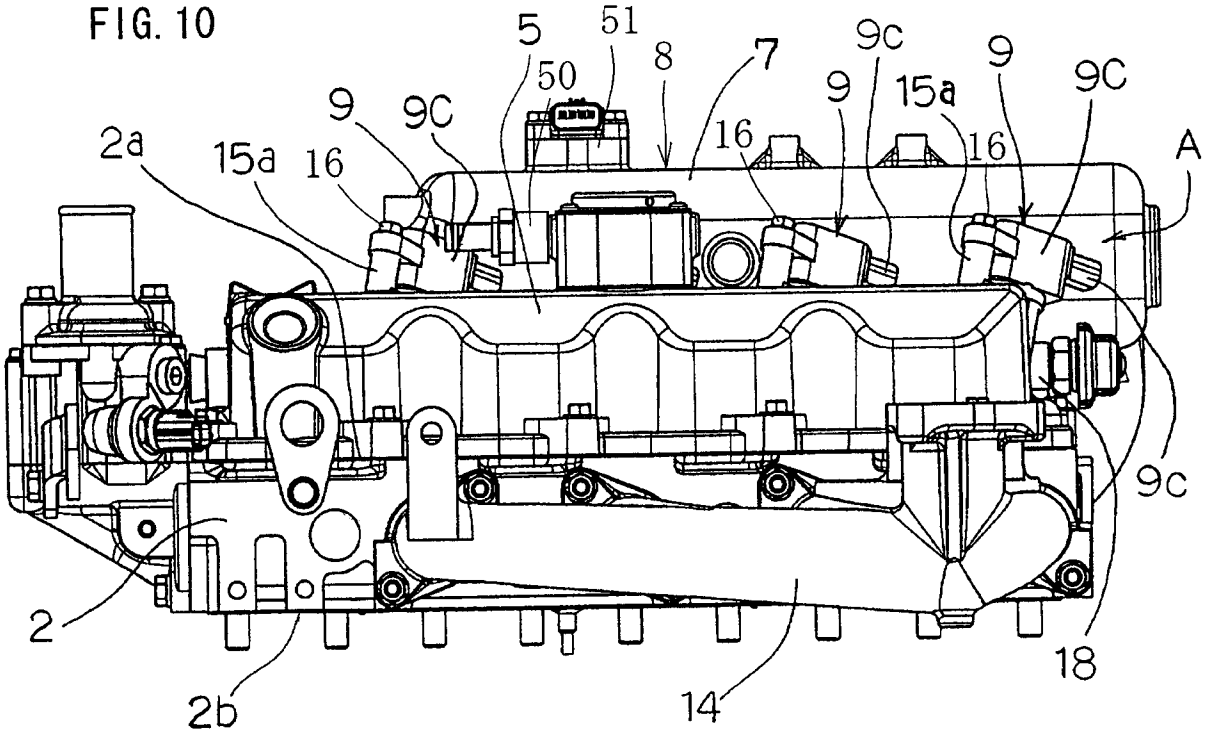
FIG. 10 is a side view showing an exhaust-gas side of the head cover and its peripheral portion
Figure 11:
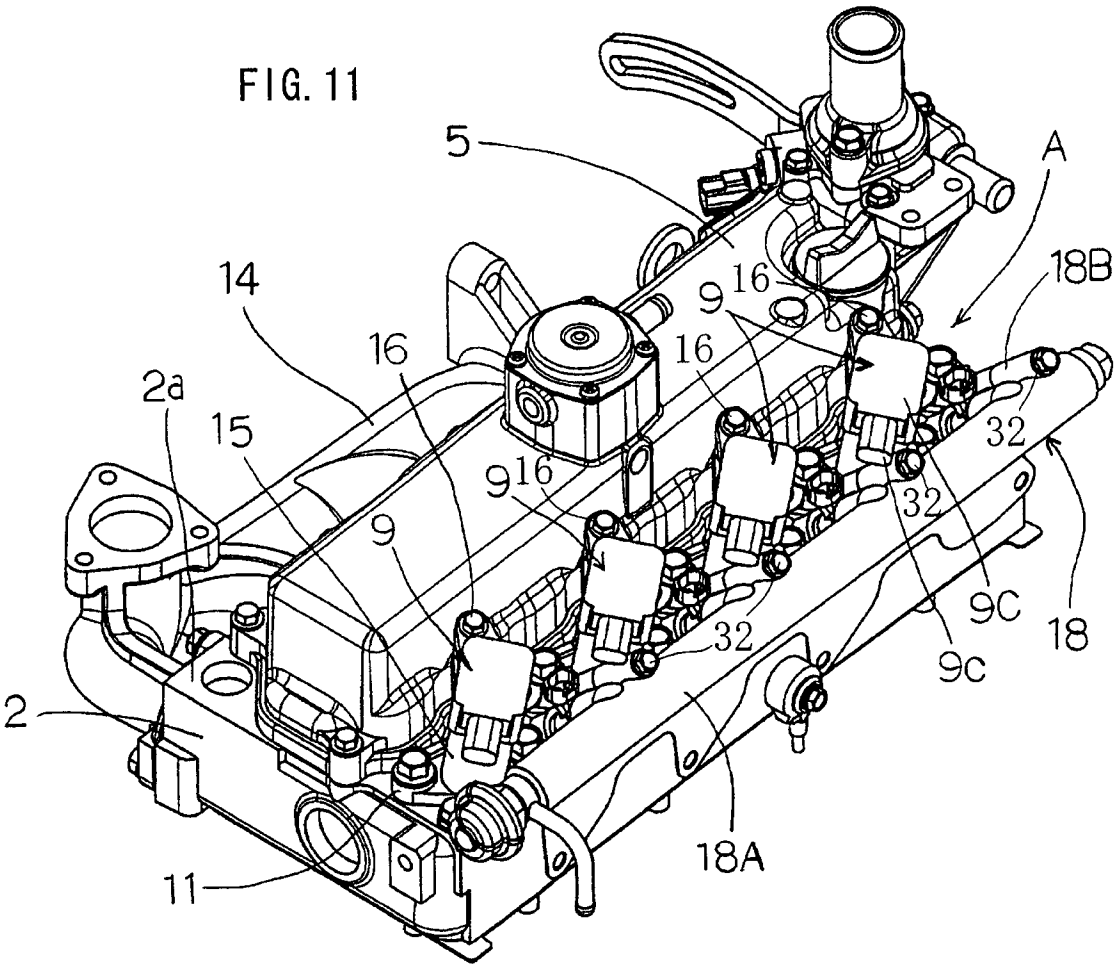
FIG. 11 is a perspective view when the head cover and its peripheral portion are seen from above obliquely.

The delivery pipe 18 is, as shown in FIG. 7, a member which comprises a single thick pipe portion 18A and raised portions 18B projecting from the thick pipe portion 18A at four positions. And it is fastened to each of the raised nut portions 11*b* through an attaching hole 26 formed in each of the raised portions 18B by a bolt. Each of the raised portions 18B is, as shown in FIG. 7(*a*) to FIG. 7(*e*), formed with an injector-attaching hole 27 to be communicated with a main flow-passage 18*a* of the pipe portion 18A, a bolt-insertion hole 26 and a threaded portion 28 for fastening the injector-stoppers 29 by bolt. More specifically, the delivery pipe 18 is provided as it is inserted by the four injectors 25 to support them and passes by every extending cylinder-portion 15 and is attached to three raised nut portions 11*b* and another raised nut portion 11*b* by a fixing means 32. This fixing means 32 is a bolt. In consequence, the delivery pipe 18 has its original function to distribute and feed the fuel to each of the injectors 25 as well as another function to support every injector 25 and still another one to reinforce three of the extending cylinder-portions 15. Thus a reasonable design is made by providing one member with multiple functions.

The injector stopper 29, as shown in FIGS. 7(*f*), 7(*g*), and 7(*h*), comprises a longer portion 29A and holding portions 29B at four positions, and is made of a metal plate material. It serves to inhibit the release of the respective injectors 25 from the delivery pipe 18. The longer portion 29A is formed at four positions with stopper holes 30 for securing itself with screws to the respective threaded portions 28, and each of the holding portions 29B is provided with a slit-groove 31 for press-inserting and fitting each of the injectors 25 thereinto. More specifically, as shown in FIG. 4, with the holding portions 29B as inserted so that the sliding slit-grooves 31 are positioned at upper portions 25*a* of the injectors 25, the longer portion 29A is screw-secured to the respective raised nut portions 28 through the stopper holes 30. Then the lower portion 25*b* is inserted into the injector-insertion hole 11*a* as sealed and the upper portion 25*a* is also inserted into the attaching hole 27 as sealed. Thus the four injectors 25 are enabled to be stably and assuredly supported by the plug-cap attaching flange 11.

It is to be noted that in FIG. 7(*g*), numeral 31*a* indicates a groove for stopping rotation, which engages with a rotation-stopping projection 25*d* of the injector 25 so as to position the connector 25*c*.

During the actual assembling work, four injectors 25, four plug caps 9, a delivery pipe 18 and injector-stoppers 29 are preliminarily assembled to the plug-cap attaching flange 11 into one-piece. If the plug-cap attaching flange 11 pre-assembled into one-piece as such (ASSY) is attached to the cylinder head 2, the ignition device (A) can be assembled efficiently. First, four injectors 25 have their upper portions 25*a* inserted into the corresponding injector-attaching holes 27. Then the injector-stoppers 29 are inserted into the respective upper portions 25*a* and engaged with the respective threaded portions 28 by screws for fastening purpose. Subsequently, four raised portions 18B are fastened to the raised nut portions 11*b* by bolts, which are fixing means 32, while maintaining the delivery pipe 18 provided with four injectors 25 as their lower portions 25*b* at four positions are inserted into the corresponding injector-insertions portions 11*a*.

Then the plug caps 9 have their holder portions 9A inserted into the extension holes 15A at the four positions and subsequently have their flanges 9K attached to the attaching arm-portions 15*a* in screw-thread engagement through bolts 16, thereby integrally forming the injectors 25, the delivery pipe 18 and the plug caps 9, with the plug-cap attaching flange 11. For instance, in a production factory, it enables the following efficient work to be done, which comprises:

conducting on a sub-production line a pre-assembling step for assembling various kinds of parts such as the plug caps 9, to the plug-cap attaching flange 11 into one-piece body; and assembling the thus pre-assembled one-piece body to the cylinder head 2 of the engine's main body moving on a main production-line.

As shown in FIGS. 1 to 4, the extending cylinder-portion 15, the injector 25 and the delivery pipe 18 are arranged within the air-conduction passage 42 for the engine cooling-air to be sent by the engine cooling-fan 41.

The air-conduction passage 42 has left and right air-conducting guide portions, which are constructed from an intake manifold 8 and the head cover 5.

Figure 2:
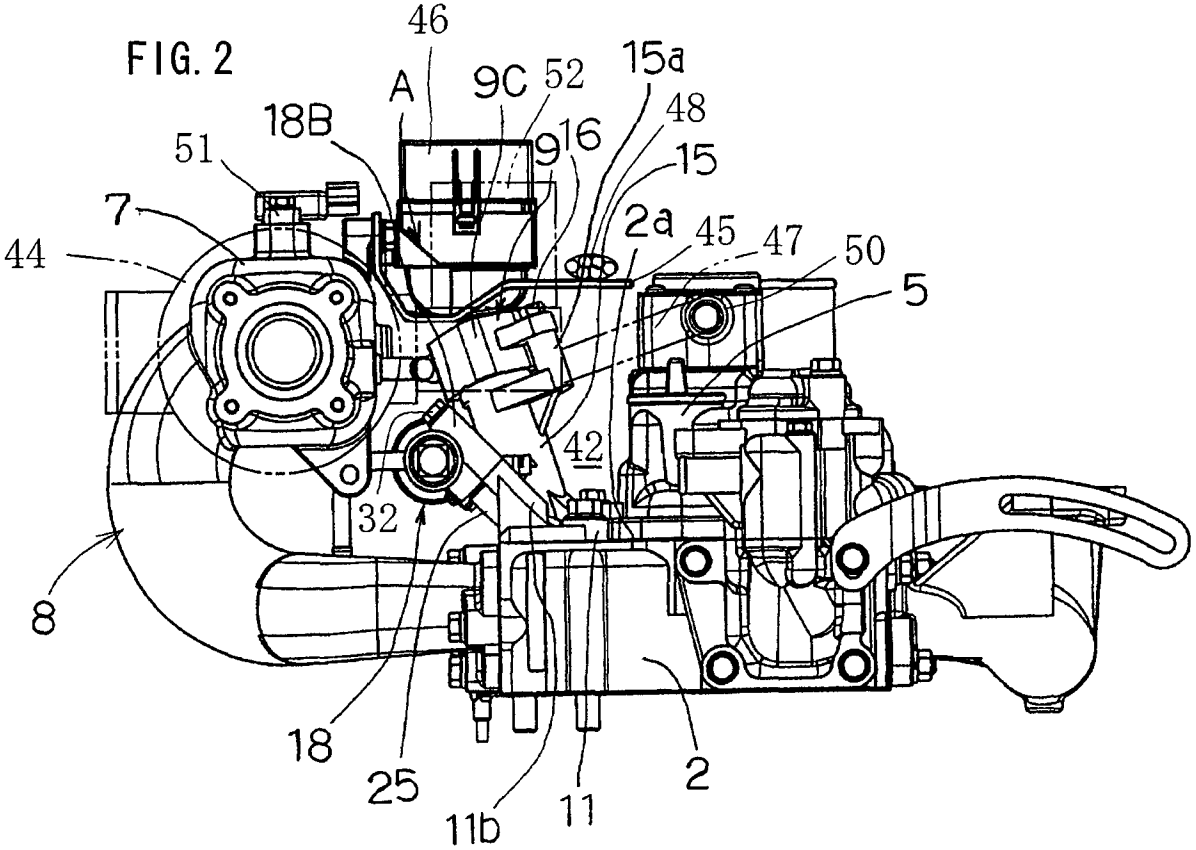
FIG. 2 is a front view showing a head cover and its peripheral portion.

As shown in FIGS. 1 and 2, the intake manifold 8 has a main pipe 7 to a front end portion of which a throttle body 43 is attached. This throttle body 43 and the head cover 5 form the left and right air-conducting guide portions of an inlet portion 42A of the air-conduction passage 42. A throttle valve (not shown) disposed inside the throttle body 43 is driven by a electric-actuator 49 additionally provided in the throttle body 43.

As shown in FIG. 1, the throttle body 43 has a front end portion to which a gas mixer 44 is attached. The gas mixer 44 has a horizontal side to which a vaporizer 52 is attached.

As shown in FIGS. 1 and 2, the air-conduction plate 45 is arranged on the upper side of the air-conduction passage 42 while covering it from above. The electronic-parts housing portion 46 is disposed on the upper surface of the air-conducting plate 45. The electronic-parts housing portion 46 houses electronic parts such as fuses.

The wire harness 48 is supported by the upper surface of the air-conducting plate 45 and electrically connects to the ECU (not shown), electronic parts such as the coil portion 9C of the plug cap 9, the electric actuator 49 for the throttle body 43, an engine rotation-number sensor (not shown), a crank-angle sensor (not shown), a cylinder-judging sensor (not shown), an intake pressure and temperature sensor 51. The wire harness 48 is fixed to the air-conducting plate 45 through a clamp or the like. The ECU is an abbreviation of "Engine Control Unit".

The air-conducting plate 45 is attached to the intake manifold 8.

As shown in FIG. 3, a breather passage 47, which extends from the head cover 5 side to the intake manifold side, is arranged at a portion which the engine cooling-air blows against. The breather passage 47 communicates the PCV valve 50 provided in the head cover 5 with the intake manifold 8. The PCV is an abbreviation of "Positive Crankcase Ventilation".

As explained above, the spark-ignition plug according to the present invention offers the following function and effect.

The plug cap 9 is so constructed that it is inserted for provision into the plug hole 13 formed in the cylinder head 2 at a position laterally offset of the head cover 5. This construction solves and alleviate the likelihood that the engine oil, which is sprinkled within the head cover 5, leaks into the plug hole 13. The plug cap 9 has the holder portion 9A an upper portion of which is accommodated in the extension hole 15A of the extending cylinder-portion 15 and the extension hole 15A has an upper end covered with the cap portion 9B. Further, the plug-cap attaching flange 11 is attached to the head upper-surface 2*a* through the gasket 17. This removes the likelihood that the garbage, the dust and the like foreign matters invade the plug hole 13 and the extension hole 15A, thereby enabling a good spark-ignition function to be maintained.

And the plug cap 9 has the coil portion 9C, its upper portion, which is constructed so that it is fastened by bolt to the upper end portion (an attaching arm-portion 15*a*) of the extending cylinder-portion 15 through the flange 9K. Therefore it is longer vertically. Further, the plug cap 9, which tends to balance upwardly because the heavier coil portion 9C is arranged at its upper portion, can be assuredly and fixedly supported without swinging. Besides, the coil portion 9C is separated by using the extending cylinder-portion 15 upwardly of the cylinder head 2, so as to inhibit the overheating of the coil portion 9C. Additionally, each of the plug hole 13 and the extension hole 25A is so inclined that the more the upper portion goes up, the more laterally it separates from the head cover 5. This arrangement offers an advantage that the heat of the head cover 5 hardly reaches the coil portion 9C.

The plug-cap attaching flange 11 including the extending cylinder-portion 15 is produced as an independent part and is constructed so that it is attached to the upper surface 2*a* of the cylinder head 2, depending on the attaching condition of the head cover 5. Accordingly, when compared with the case of integrally forming the plug-cap attaching flange 11 with the cylinder head 2, it becomes easy to form (or work) the cylinder head 2. Further, it facilitate the handling of the cylinder head 2 during the production process because there is no extending cylinder-portion 15 which projects largely. In addition, it presents such a good workability that it is sufficient if the head upper-surface 2*a* is worked as a single flat surface.

The extending cylinder-portions 15 largely projecting from the flange portion 11A at three positions are fastened by bolts through using the delivery pipe 18 that is arranged aside their upper portions, thereby enabling an integral reinforcement to be made with the result of inhibiting the swing of the extending cylinder-portion 15. This can attempt to increase the lifetime-period of the plug-cap attaching flange 11 or the plug cap 9.

EXPLANATION OF NUMERALS

2 cylinder head
2*a* head surface
5. head cover
7 main pipe
8 intake manifold
9 plug cap integral with an ignition coil
9C coil portion
10 ignition plug
11 plug-cap attaching flange
11*a* injector-insertion hole
12 plug-attaching aperture
13. plug hole
15 extending cylinder-portion
15A extension hole
17 sealing means
18 delivery pipe
25 injector
32 fixing means
41 engine cooling-fan
42 air-conduction passage
42A inlet portion
43 throttle body
45 air-conducting plate
46 electronic-parts housing portion
47 breather passage
48 wire harness

What we claim is:

1. A spark-ignition engine comprising:

a plug hole (13) provided with a plug-attaching aperture (12) at an innermost portion thereof and formed in a cylinder head (2);

an ignition plug (10) engaged in screw-thread relationship with the plug-attaching aperture (12); and a plug, cap (9) integral with an ignition coil and attached to the ignition plug (10) upon insertion of the plug cap (9) into the plug hole (13), wherein the plug hole (13) is arranged at a position outside a head cover (5) at the cylinder head (2), a head surface (2*a*) being opened to provide the plug hole (13) and having a plug-cap attaching flange (11) attached thereto, the plug-cap attaching flange (11) being formed with an extending cylinder-portion (15) having an extension-hole (15A) communicated with the plug hole (13), the plug cap (9), as inserted from the extension hole (15A) into the plug hole (13), having a coil portion (9C) fixed to the extending cylinder-portion (15), and wherein the plug-cap attaching flange (11) is attached to the head surface (2*a*) at a position spaced-apart from the head cover (5), the extending cylinder-portion (15) being spaced-apart from the head cover (5) and extending upwardly from the plug-cap attaching flange (11), the extension hole (15A) of the extending cylinder-portion (15) being longer than the plug hole (13), and the coil portion (9C) of the plug cap (9) being fixed to an upper end portion of the extending cylinder-portion (15) at a position spaced-apart from the head cover (5).

2. The spark-ignition engine as set forth in claim 1, wherein:

a plurality of plug holes (13) are provided and the extending cylinder-portion (15) is provided in a plural number in correspondence with a number of the plug holes (13), and a plurality of extending cylinder-portions 15 are each integrally formed with only one of the plug-cap attaching flanges (11).

3. The spark-ignition engine as set forth in claim 1, wherein:

a plurality of plug holes (13) are provided and the extending cylinder-portion (15) is provided in a plural number in correspondence with a number of the plug holes (13), and a delivery pipe (18) for distributing a fuel to an injector (25), which is provided in a plural number in correspondence with the number of the plug holes (13), being provided as the delivery pipe (18) passes by a plurality of extending cylinder-portions (15) and is attached to at least two of the extending cylinder-portions (15), respectively through fixing means (32).

4. The spark-ignition engine as set forth in claim 3, wherein the plurality of extending cylinder-portions (15) are each integrally formed with only one of the plug-cap attaching flanges (11).

5. The spark-ignition engine as set forth in claim 4, wherein a plurality of injectors (25) are attached to the delivery pipe (18), and the respective injectors (25) are inserted into a plurality of injector insertion-holes (11*a*) provided in the plug-cap attaching flange (11).

6. The spark-ignition engine as set forth in claim 1, wherein the plug-cap attaching flange (11) is attached to the head surface (2*a*) through a sealing means (17) and the plug cap (9) is constructed to form a cap for the extension hole (15A).

7. The spark-ignition engine as set forth in claim 6, wherein the sealing means (17) is a gasket.

8. The spark ignition engine as set forth in claim 1, further comprising:

a delivery pipe (18) for distributing a fuel to a plurality of injectors (25) in correspondence with a number of the plug holes (13), being provided as the delivery pipe (18) passes by a plurality of extending cylinder-portions (15);

an air-conduction plate (45) attached to an intake manifold (8); and an air-conduction passage (42) covered by the air-conduction plate (45) from above, the air conduction passage (42) having left and right air-conducting guide portions, which are constructed from the intake manifold (8) and the head cover (5), respectively, wherein the head cover (5) and an intake manifold (8) are arranged side by side, engine cooling-air being sent to the air-conduction passage (42) by an engine cooling fan (41), and a plurality of extending cylinder-portions (15), a plurality of injectors (25) and the delivery pipe (18) being arranged within the air-conduction passage (42).

9. The spark-ignition engine as set forth in claim 8, wherein the intake manifold (8) has a main pipe (7) including a front end portion which is attached to a throttle body 43, the throttle body (43) and the head cover (5) forming the left and right air-conducting guide portions of an inlet portion (42A) of the air-conduction passage (42).

10. The spark-ignition engine as set forth in claim 8, wherein an electronic-parts housing portion (46) is attached to an upper surface of the air-conduction plate (45), the electronic-parts housing portion (46) housing electronic parts.

11. The spark-ignition engine as set forth in claim 10, wherein a wire harness (48) is supported by the upper surface of the air-conduction plate (45).

12. The spark-ignition engine as set forth in claim 8, wherein a breather passage (47), which extends from a head cover (5) side to an intake manifold (8) side, is arranged at a portion which engine cooling-air blows against.

* * * * *